US005795089A

United States Patent [19]

Ong

[11] Patent Number: 5,795,089

[45] Date of Patent: Aug. 18, 1998

[54] TRANSPARENCY SHEET PROTECTOR

[76] Inventor: Bon S. Ong, P.O. Box 4247, Torrance, Calif. 90510

[21] Appl. No.: 730,356

[22] Filed: Oct. 15, 1996

[51] Int. Cl.[6] ..... B42F 13/00

[52] U.S. Cl. ..... 402/79; 281/38; 402/4

[58] Field of Search ..... 402/4, 79; 281/38

[56] References Cited

U.S. PATENT DOCUMENTS

| | | | |
|---|---|---|---|
| 3,145,839 | 8/1964 | Lowry | 402/4 |
| 3,565,462 | 2/1971 | Gottlieb | 281/38 |
| 4,810,544 | 3/1989 | Hickman | 281/38 |
| 5,265,359 | 11/1993 | Glazer et al. | 402/79 |
| 5,393,158 | 2/1995 | Dall'arancio | 402/79 |
| 5,437,514 | 8/1995 | Minch | 281/38 |
| 5,466,008 | 11/1995 | Ozeki | 281/38 |
| 5,630,626 | 5/1997 | Harper | 281/38 |

*Primary Examiner*—Daniel W. Howell
*Assistant Examiner*—Adesh Bhargava
*Attorney, Agent, or Firm*—Charles H. Thomas

[57] ABSTRACT

A device is provided for protecting a transparent display sheet bearing material thereon for projected display. Such protective devices typically employ blank, opaque backing sheets that are secured to a pair of transparent protective sheets forming a pocket for the display sheet, or directly to the display sheet itself. According to the invention, and unlike prior systems, the backing sheet is divided by a longitudinal fold into a pair of panels. One of these panels resides immediately adjacent the edge at which the backing sheet is connected to the transparent display sheet. The other panel is located remote from the connecting edge of the backing sheet, and may be folded back beneath the first panel so that the entire structure will fit atop the stage of a conventional machine for projecting images from transparent display sheets. This construction prevents the backing sheet from overhanging the edge of the stage and falling off during a presentation.

15 Claims, 6 Drawing Sheets

TRANSPARENCY SHEET PROTECTOR

BACKGROUND OF THE INVENTION

1. Field of the Invention

The present invention relates to protective devices for use with transparent display sheets that bear material for projected display.

2. Description of the Prior Art

For many years transparent display sheets have been utilized as visual aids in instructional and promotional presentations. Transparent display sheets are typically formed of thin sheets of transparent, plastic material upon which graphs, drawings, text, and other informative materials are printed in dark lines. The transparent display sheets are typically positioned atop a glass or plastic stage of an image projection machine. A light beneath the transparent or translucent stage shines up through the transparent display sheet. The image produced is directed onto a mirror and magnification system, which reflects the image laterally onto a flat, vertical, light colored surface, such as a white projection screen. The magnification and projection of the image in this fashion allow the image to be seen quite easily from a distance by all individuals in the immediate vicinity. The use of transparent display sheets in this manner allows a lecturer to present a visual display to a far greater number of individuals than would be able to concurrently view the transparent display sheet directly.

Both to protect the transparent display sheet and to permit its storage and to allow it to be displayed to a more limited audience, the transparent display sheet may be provided with an opaque backing. The opaque backing is typically secured to the transparent display sheet along mutually adjacent side edges, which may be considered to be the connecting edges of the backing and the transparent display sheet. The backing sheet is typically blank on one of its expansive surfaces. The backing sheet can be folded from the mutually connecting edges toward the display sheet so that the blank surface of the backing sheet faces the display sheet and resides in contact therewith.

The backing is typically wider than the display sheet and is hole punched along a margin thereof which is parallel to and remote from the connecting edge at which the backing sheet is joined to the display sheet. This construction allows the display sheet to be secured in a ring binder by means of its connection to the backing sheet, and the holes in the margin of the backing sheet through which the rings of the ring binder pass. Such a construction facilitates viewing of the transparent display sheet to be viewed while it remains in the binder. The blank, opaque surface of the backing sheet that faces the display sheet when the backing sheet is folded to underlie the display sheet and placed in the binder provides a clear contrast with the information printed or drawn on the transparent display sheet.

In an alternative construction the backing sheet is connected to a pair of transparent protective sheets along a connecting edge of the backing sheet. The transparent protective sheets are secured to each other and to the backing sheet along mutually adjacent connecting edges thereof. While the transparent protective sheets may be joined together only along the connecting edge, and thereby folded open in the manner of a booklet, more typically they are each secured together along three of their edges to form a pocket therebetween. In either case the transparent display sheet bearing the material for projected display is positioned between the two transparent protective sheets. The use of transparent protective sheets in this manner allows different transparent display sheets to be inserted into the pocket formed between the transparent protective sheets, or merely placed between the transparent protective sheets if the transparent protective sheets are only secured together at a single, linear marginal edge connection.

In the use of transparent display sheets joined to opaque backings of the type described, the transparent display sheet and the backing must be unfolded from each other along their mutually adjoined, connecting edges in order for an image to be generated from the passage of light through the transparent display sheets, and projected onto a projecting screen. To do this the opaque backing sheet is unfolded from contact with the transparent display sheet and disposed in a substantially coplanar relationship therewith atop the stage of the image projector. Also, in some systems explanatory material may be printed on the reverse side of the backing sheet that faces upwardly when the transparent display sheet and the backing sheet are unfolded from each other and placed atop the projector stage.

When the transparent display sheet and the backing sheet are unfolded from each other and placed atop a projector stage, only the transparent display sheet resides on that portion of the stage through which an image is projected for magnification and projected display. Thus, the explanatory material is not projected, but is visible to a lecturer controlling the projection of the material imprinted on the transparent display sheet. This explanatory material serves as a set of notes useful to the lecturer in explaining the material being projected.

One significant disadvantage of conventional transparency display systems of the type described is that the stage on visual image projection systems designed for use in the projected display of material imprinted on transparent display sheets are not large enough to accommodate both the transparent display sheet and the backing sheet when those two sheets are unfolded from each other. The backing sheet must necessarily be at least as large as the transparent display sheet so as to provide an opaque, contrasting surface over the expanse of the transparent display sheet in order for different transparent display sheets to be distinguished from each other when stacked together for storage.

However, conventional visual image projection machines have stages with a surface area only slightly larger than the display sheet itself. As a consequence the backing sheet typically hangs over the edge of the stage when the image on the transparent display sheet is being projected onto a projection screen. The weight of the portion of the backing sheet extending out over the edge of the stage is often sufficient to cause the backing sheet to fall under the force of gravity, carrying the transparent display sheet with it. Also, the lecturer or others in the vicinity are likely to brush against the overhanging backing sheet, thereby knocking it to the floor. When this occurs there is a significant disruption in the lecturer's presentation.

SUMMARY OF THE INVENTION

The present invention involves an improved device for protecting a transparent display sheet bearing material thereon for projected display. The device of the invention facilitates the use of a transparent display sheet both during an image projection presentation and during viewing directly and storage in a ring binder.

According to the present invention the opaque backing sheet that is connected to the transparent display sheet is divided into laterally adjacent panels by a longitudinal fold, which may be created by scoring the opaque backing linearly parallel to the connecting edge. The pair of panels thereby formed in the backing sheet may be easily folded together, so that both panels reside proximate to the transparent display sheet, or unfolded from each other into substantially coplanar relationship.

When the panels are folded together into mutually overlying relationship relative to each other adjacent the connecting edge at which the backing sheet is secured to the transparent display sheet, the area that they occupy parallel to the plane of the stage is diminished by approximately one-half. As a consequence, the backing sheet does not hang over the edge of the stage at all, or at least not to any significant extent. As a result, the backing sheet is totally or almost entirely supported from beneath by the peripheral area of the stage. The backing sheet therefore does not tend to hang over the edge of the stage, and will not fall from the stage carrying the display sheet with it.

In one broad aspect the present invention may be considered to be a combination of a rectangular, transparent display sheet having top and bottom edges and side edges and having material thereon for projected display, and a rectangular opaque backing sheet at least as large as the transparent display sheet and improved according to the invention. The backing sheet is secured to the transparent display sheet along one of the side edges of the transparent display sheet. According to the improvement of the invention the backing sheet has a longitudinal panel delineation fold extending between and perpendicular to the top and bottom edges thereof. This fold divides the backing sheet into a pair of panels, one of the panels being bounded by the transparent display sheet along one of its sides and by the other of the panels along an opposite one of its sides.

According to the invention the backing sheet may either be secured directly to the transparent display sheet, or it may be secured thereto through the intermediate connection with first and second transparent protective sheets of generally rectangular configuration. When transparent protective sheets are employed the transparent display sheet is disposed between the transparent protective sheets. Each protective sheet has a top edge and a bottom and a pair of side edges. At least one of the side edges of each transparent protective sheet is a connecting edge.

The sides edges of the transparent protective sheets are greater in length than their top and bottom edges thereof. The transparent protective sheets are disposed in mutually overlying relationship and are secured together along their connecting edges, which are mutually adjacent to each other. The generally rectangular, opaque backing sheet also has a top edge, a bottom edge, and a pair of side edges, one of which is a connecting edge. The backing sheet is at least as large as each of the transparent protective sheets and is joined along its connecting edge to the connecting edges of the transparent protective sheets. The opaque sheet is divided into a panel adjoining the connecting edges and a panel remote from the connecting edges by a longitudinal panel delineating fold. This delineating fold extends between the top and bottom edges of the backing sheet.

While the first and second transparent protective sheets may be joined to each other only along their mutually adjacent, connecting edges, more typically they are disposed in mutually overlying relationship and secured together along several edges, typically being left unjoined along only their top edges, their bottom edges, or their side edges opposite their connecting edges. The first and second transparent protective sheets thereby form a transparent pocket therebetween that receives the transparent display sheet.

The backing sheet may be folded relative to the protective sheets so that the two panels of the backing sheet reside in substantially coplanar relationship and in a laterally adjacent disposition relative to each other. The entire backing sheet may thereupon be folded relative to the pocket into an underlying relationship relative thereto. Alternatively, the backing sheet may be unfolded from the pocket and the panels can be folded along the longitudinal panel delineation fold to reside in face-to-face disposition relative to each other. In this arrangement the entire structure extends over an area approximately one and a half times the area of the pocket alone. This area is normally small enough to fit atop the stages of most conventional image projectors.

The invention may be described with greater clarity and particularity by reference to the accompanying drawings.

DESCRIPTION OF THE EMBODIMENTS

Figure 1:
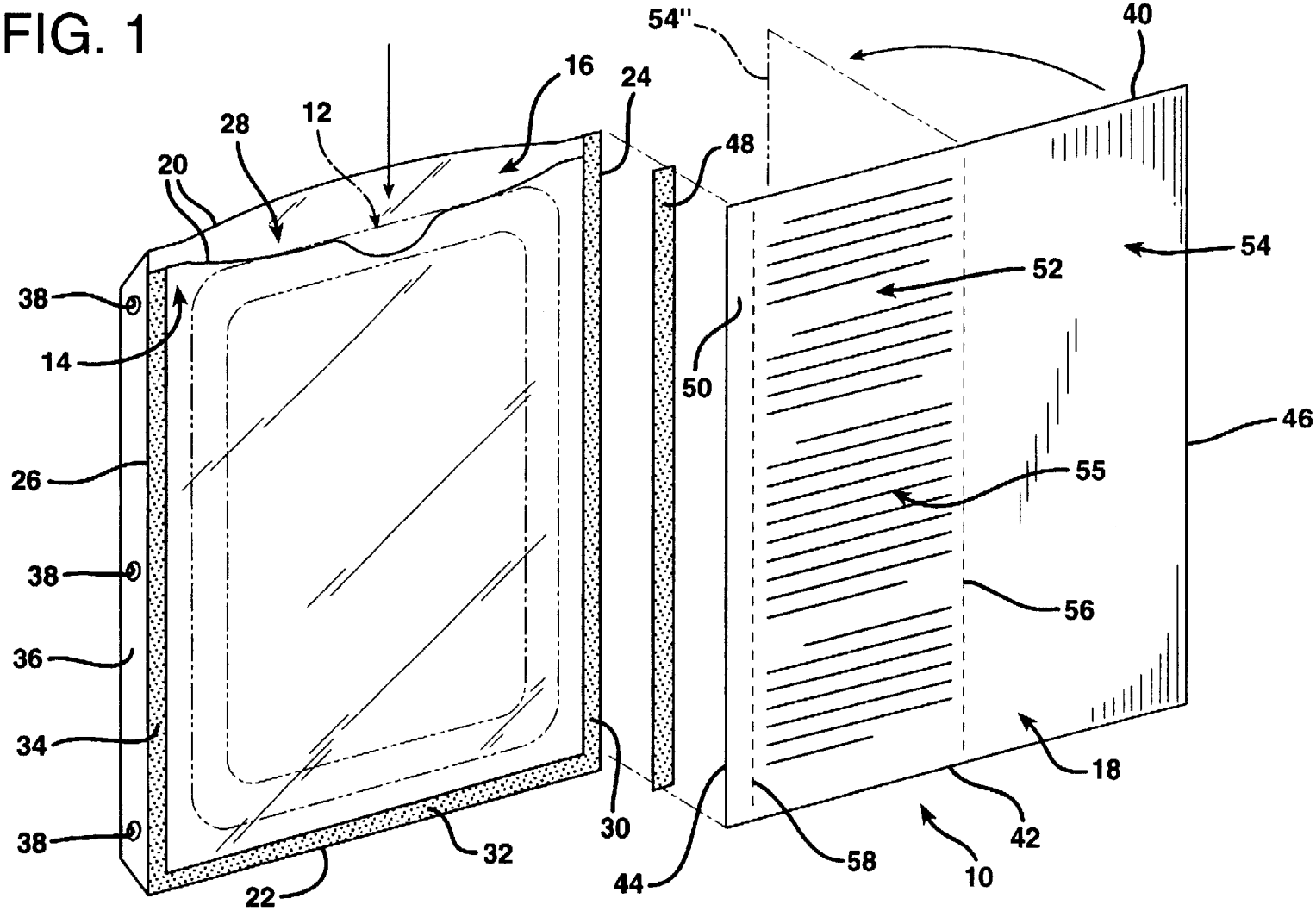
FIG. 1 is an exploded perspective view illustrating a protector for a transparent sheet bearing material thereon for projected imaging constructed according to the invention.
Figure 2:
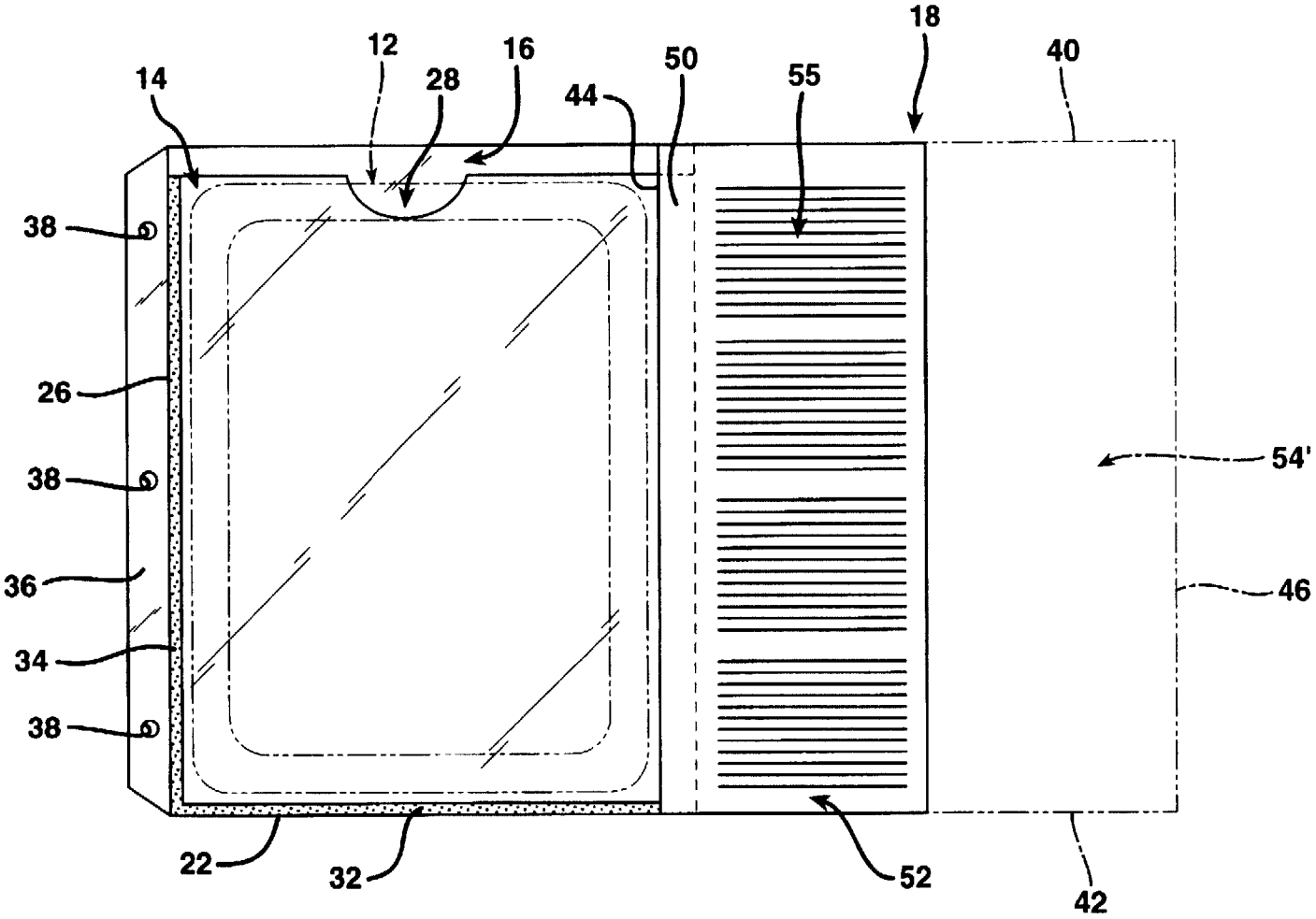
FIG. 2 is a top plan view of the protector of FIG. 1 illustrated in a folded condition.

FIGS. 1 and 2 illustrate a device 10 for protecting a transparent display sheet 12 that bears material thereon for projected display. The protecting device 10 is formed of first and second transparent sheets 14 and 16 and an opaque backing sheet 18. The transparent sheets 14 and 16 may be die cut from flat, thin polyethylene stock, while the opaque backing sheet 18 may be die cut from flat, thin, paper stock. Each of the first and second transparent protective sheets 14 and 16 has a top edge 20, a bottom edge 22, and a pair of side edges 24 and 26. The side edges 24 and 26 are greater in length than the top and bottom edges 20 and 22.

One of the side edges of each of the transparent protective sheets 14 and 16 is a connecting edge. In the embodiment of FIGS. 1 and 2, the connecting edge of each of the transparent protective sheets 14 and 16 is the side edge 24.

As illustrated, the transparent protective sheets 14 and 16 are disposed in mutually overlying relationship and form a pocket 28 therebetween. The transparent protective sheets 14 and 16 are secured to each other along their connecting edges 24, their side edges 26, and along their bottom edges 22, typically by heat sealing in the mutually contacting, marginal regions indicated at 30, 32, and 34. The sealing area of mutual contact along the marginal region 32 adjacent the bottom edges 22 of the transparent protective sheets 14 and 16 forms a transverse sealing area of mutual contact. This transverse sealing area extends between the sealed side edges 24 and 26 to thereby form the transparent pocket 28 for the transparent display sheet 12.

At least one of the edges of at least one of the transparent protective sheets 14 and 16 may be formed with a hole-punched attachment margin. In the embodiment of FIGS. 1 and 2, both the transparent protective sheets 14 and 16 are formed with an attachment margin 36 that is punched with three one-quarter inch diameter holes 38 spaced longitudinally along the attachment margin 36 four and a quarter inches apart from each other. With this size and spacing of hole punching, the attachment margins 36 form a means by which the device 10 may be secured in a standard, three-ring binder. The attachment margin 36 extend laterally from the side edges 26 opposite the connecting edges 24 of both the transparent protective sheets 14 and 16.

The backing sheet 18 is also of rectangular configuration and has mutually parallel top and bottom edges 40 and 42, respectively, and mutually parallel side edges 44 and 46. The side edge 44 of the backing sheet 18 is a connecting edge.

The backing sheet 18 is at least as large as the pocket 28. The backing sheet 18 is secured to at least the first transparent sheet 14 along the connecting edge 24 thereof. In the embodiment of FIGS. 1-2, the backing sheet 18 is secured to both the transparent protective sheets 14 and 16 along their connecting edges 24 by a layer of adhesive 48. The adhesive layer 48 secures the backing sheet 18 to both of the transparent protective sheets 14 and 16 by joining the marginal region 50 of the backing sheet 18 adjacent the connecting edge 44 to the connecting edge marginal regions 30 of the transparent protective sheets 14 and 16. The backing sheet 18 is thereby secured to the transparent sheets 14 and 16 along its connecting edge 44.

The backing sheet 18 is delineated into a pair of panels 52 and 54 by a longitudinal fold along a scored line 56 parallel to the side edges 44 and 46 and located midway therebetween. The longitudinal fold line 56 extends the entire length of the backing sheet 18 between the top and bottom edges 40 and 42 thereof. Another scored fold line 58 delineates the panel 52 from the marginal region 50 adjacent the connecting edge 44.

The panels 52 and 54 may be folded together, residing in mutually coplanar relationship, along the fold line 58 located parallel to and proximate to the connecting edge 44, so as to underlie the pocket 28. In this disposition the backing sheet 18 underlies the pocket 28. When folded together in this manner the panels 52 and 54 form a flat, blank surface, typically colored white, that is visible by a viewer facing the transparent protective sheet 14. Any material printed on the transparent display sheet 12 is thereby visible through the transparent protective sheet 14 and is discernable in sharp contrast against the plain white reverse surface of the backing sheet 18 that is visible through the transparent protective sheets 14 and 16 and the transparent display sheet 12 itself.

Alternatively, the panels 52 and 54 may folded together, still in coplanar relationship, by folding the backing sheet 18 away from the pocket 28 by rotation of the panels 52 and 54 together along the fold line 58. They thereupon reside in the mutually coplanar disposition and substantially coplanar with the pocket 28.

Unlike conventional systems, however, the backing sheet 18 forms laterally adjacent panels 52 and 54 which are further foldable along the fold line 56, so that the panels 52 and 54 reside in a face-to-face disposition. The panel 54 is indicated in phantom at 54" in FIG. 1 in an intermediate position as it is being folded to reside in face-to-face disposition relative to the panel 52. When folded in this manner panel 54 resides directly beneath the panel 52 and therefore does not extend any significant distance beyond the edge of a stage atop which the transparent display sheet 12 is positioned for projected imaging.

FIG. 2 illustrates the protective device 10 in the condition in which the panel 54 is folded underneath the panel 52 for positioning atop a projector stage. An alternative position of the panel 54 in which it is foldable to reside in a coplanar, laterally adjacent disposition relative to the panel 52 is indicated in phantom at 54' in FIG. 2. When the device 10 is folded as illustrated in solid lines in FIG. 2, the panel 54 does not hang over the edge of the stage, and therefore will not pull the protective sheets 14 and 16 and transparency 12 off of the stage surface. Also, because the device 10 lies flatter on the stage, it blocks more of the annoying light adjacent the display sheet 12 than conventional transparency display protectors.

The panel 52 contains printed matter thereon, indicated generally at 55. This printed matter is normally a description of the material on the transparent display sheet 12 or notes relating to the display sheet 12. This printed matter 55 is visible as notes to a lecturer when the protective device is placed atop a projector stage when folded to the position indicated in solid lines in FIG. 2.

Figure 3:
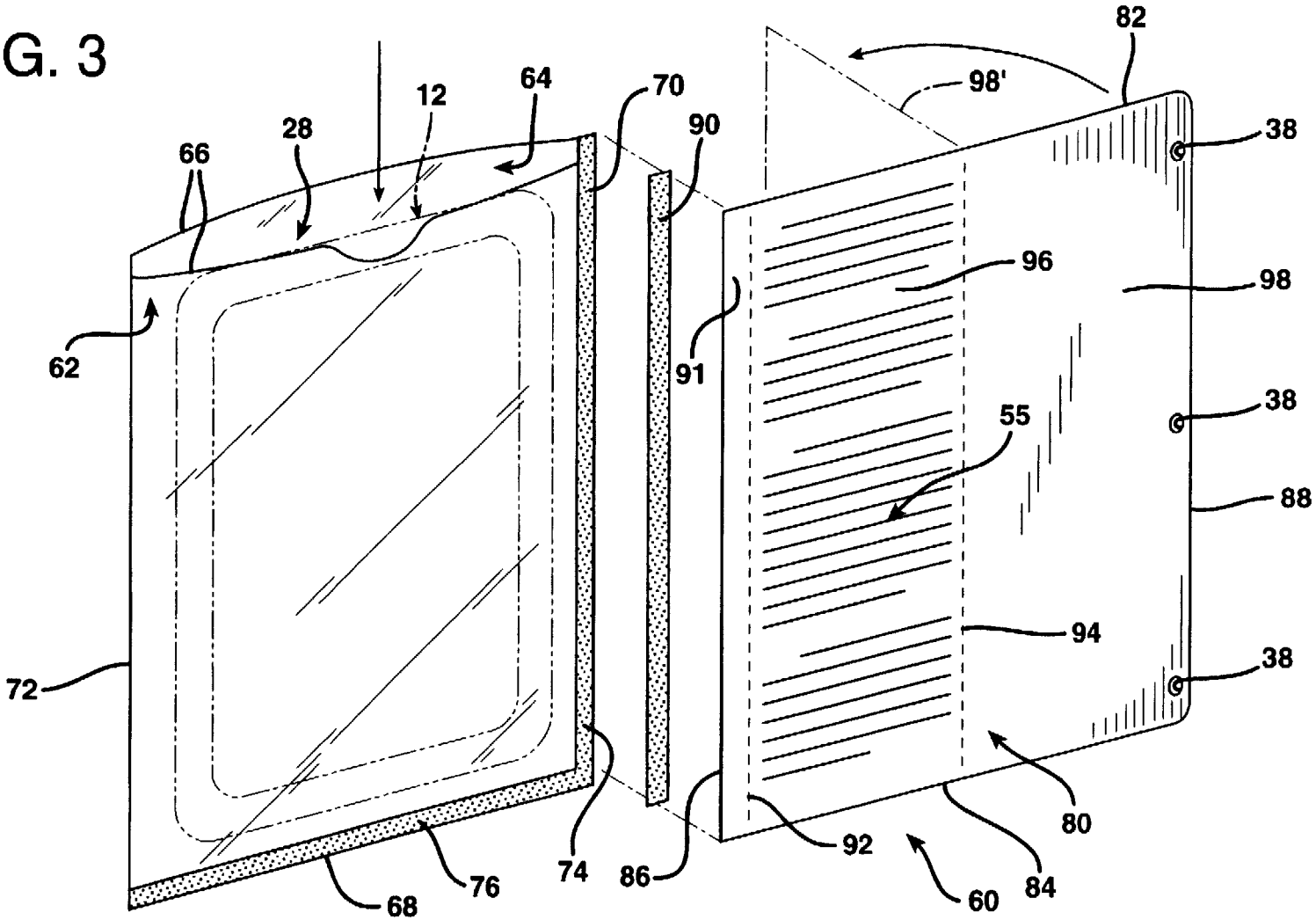
FIG. 3 is an exploded perspective view of an alternative embodiment of a protector according to the invention.
Figure 4:
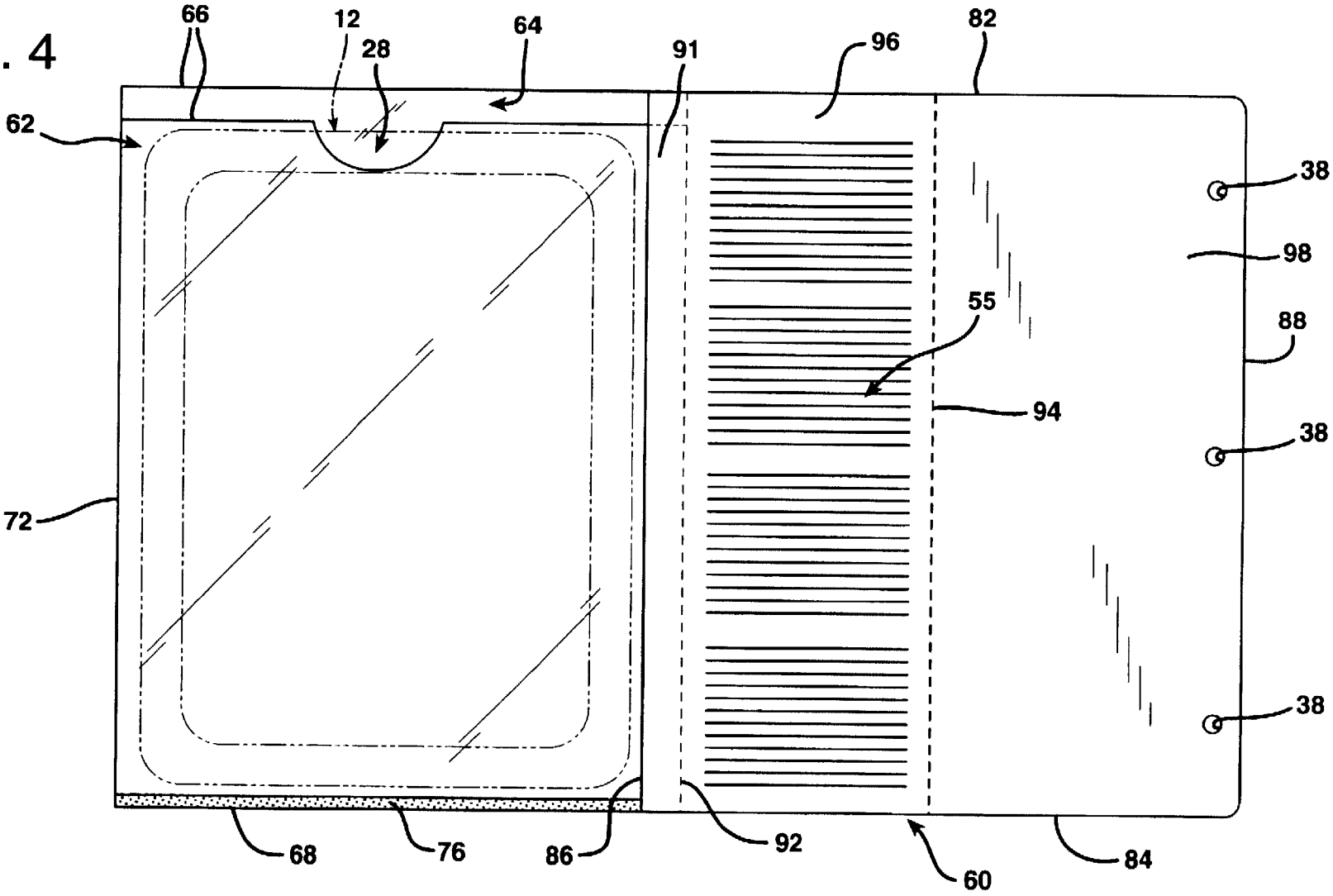
FIG. 4 is a top plan view of the embodiment of FIG. 3 shown unfolded.

FIGS. 3 and 4 illustrate an alternative embodiment of the invention. In those drawing figures the device 60 is employed to protect a transparent display sheet 12 bearing material thereon for projected display. The protective device 60 employs a first transparent protective sheet 62 and a second transparent sheet 64, both of generally rectangular configuration. Each of the transparent protective sheets 62 and 64 has a top edge 66, bottom edges 68, and a pair of side edges 70 and 72. Each of the side edges 70 is a connecting edge.

The side edges 70 and 72 are greater in length than the top and bottom edges 66 and 68. The transparent protective sheets 62 and 64 are disposed in mutually overlying relationship and are secured together along their connecting edges 70 which are mutually adjacent to each other. In the embodiment of FIGS. 3 and 4 the protective sheets 62 and 64 may both be formed from a single sheet of polyethylene stock folded lengthwise at its center to create a common side edge 72 of both of the sheets 62 and 64. The protective sheets 62 and 64 are heat sealed together along their side marginal regions 74 adjacent their connecting edges 70, and along their bottom marginal regions 76, adjacent their bottom edges 68, by thermoplastic heat sealing or sonic welding.

The protector 60, like the protector 10, also employs a generally rectangular, opaque backing sheet 80 formed of white paper. The backing sheet 80 has a top edge 82, a bottom edge 84, and a pair of side edges 86 and 88, the side edge 86 being a connecting edge. The backing sheet 80 is at least as large as, and in fact is wider than, each of the transparent protective sheet 62 and 64. The backing sheet 80 is joined along its connecting edge 86 to the connecting edges 70 of the transparent protective sheets 62 and 64 by a layer of adhesive 90. The backing sheet 80 has a first longitudinal scored fold line 92 that lies just laterally beyond the width of the layer of adhesive 90, and a second longitudinal fold line 94. The opaque backing sheet 80 is divided into a panel 96 adjoining the connecting edge 86 of the backing sheet 80 and connecting edges 70 of the protective sheets 62 and 64, and a panel 98 remote from the connecting edges 86 and 70. The backing sheet 80 is further comprised of a connection margin 91 that is delineated from the panel 96 by the longitudinal connection margin fold 92.

The panel 98 may be folded relative to the panel 96, and unfolded relative thereto by hinged movement along the fold line 94, in the same manner as the panel 54 is folded relative to the panel 52 in the embodiment of FIGS. 1-2. The panel 98 may be folded beneath the panel 96 by rotating it inwardly beneath the panel 96 as indicated in phantom at 98' in FIG. 3. Alternatively, panel 98 may be unfolded into coplanar relationship with the panel 96, as depicted in FIG. 4. In addition, the panels 96 and 98 may be rotated together, while remaining in coplanar relationship, by hinged rotation about the fold line 92 in behind the pocket created between the transparent protective sheets 62 and 64.

Like the backing sheet 18, the backing sheet 80 contains printed matter indicated generally at 55 on the front forwardly facing surface of the panel 96 adjacent the connecting edge 86.

The backing sheet 80 is wider than the pocket 28 formed between the transparent sheets 62 and 64. The marginal region of the panel 98 remote from the fold line 94 extends laterally beyond the edges 72 of the transparent protective sheets 62 and 64 when the backing sheet 80 is folded in behind the pocket 28 and when the panels 96 and 98 reside in mutually coplanar relationship. The marginal region of the panel 98 is hole punched with holes 38 spaced four and a quarter inches apart. Each hole 38 may be, for example, one-quarter inch in diameter. The holes 38 in the backing sheet 80 thereby allow the protective device 60 to be inserted into a conventional three-ring binder by securement thereto at the side edge 88 parallel to but remote from the connecting edge 86. The backing sheet 80 is wider than both of the transparent protective sheets by the width of an attachment margin that is hole punched adjacent the side edge 88 for attachment in a binder.

Figure 5:
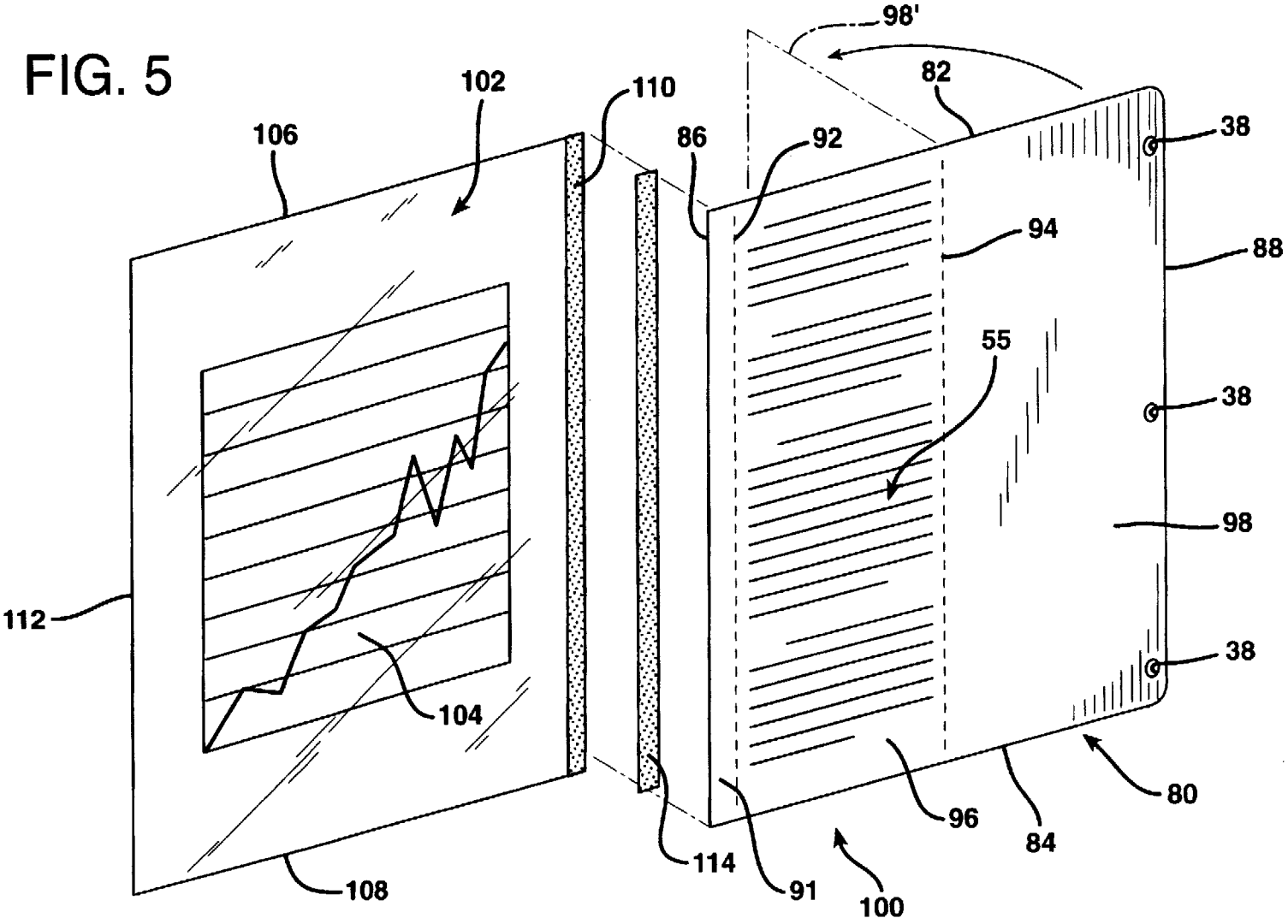
FIG. 5 is an exploded perspective view of a combination of a rectangular transparent display sheet and a backing sheet constructed according to the invention.
Figure 6:
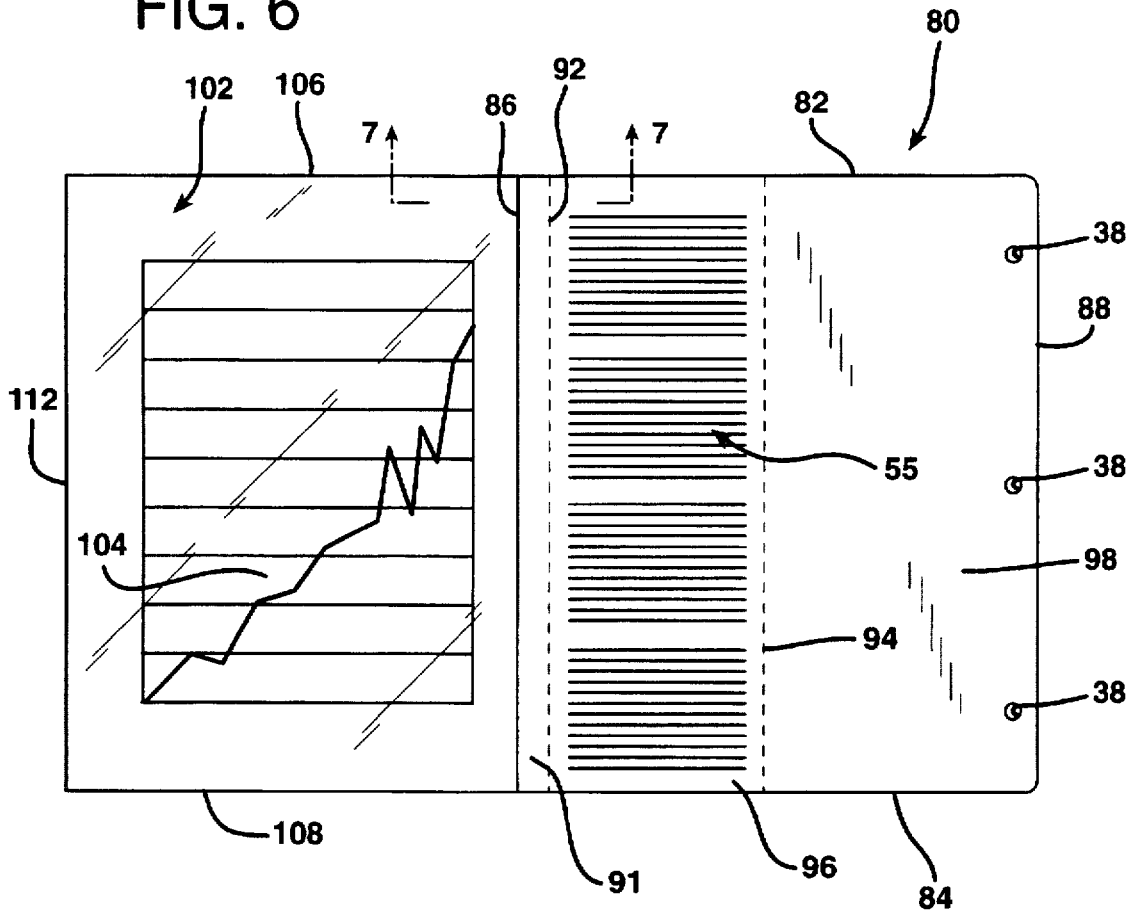
FIG. 6 is a top plan view of the combination of FIG. 5.
Figure 7:
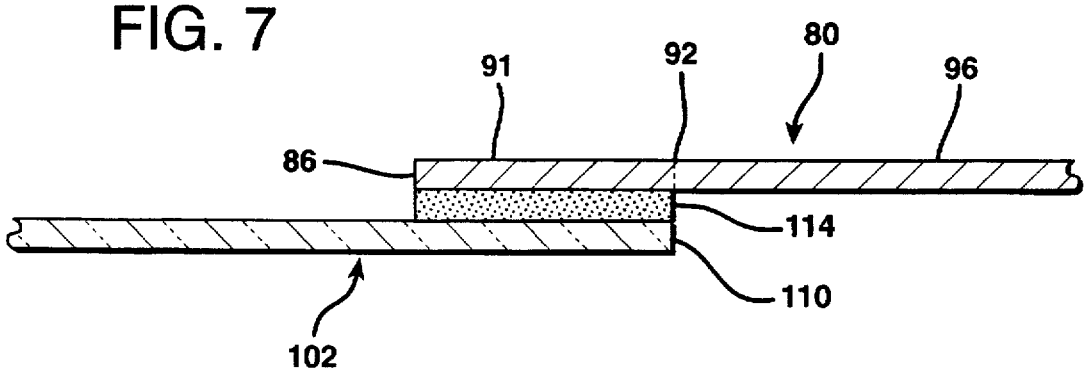
FIG. 7 is a sectional detail taken along the lines 7—7 of FIG. 6.

FIGS. 5, 6, and 7 illustrate another embodiment of the invention. FIGS. 5 and 6 illustrate a combination indicated generally at 100 including a rectangular, transparent display sheet 102 and the same backing sheet 80 employed in the protective device 60. As illustrated in FIG. 5, the transparent display sheet 102 has material 104 imprinted thereon for projected display. The material for projected display on the transparent display sheet 102 is formed as a graph.

The rectangular, opaque backing sheet 80 is at least as large, and in fact is larger, than the transparent display sheet 102. Specifically, the backing sheet 80 is wider than the transparent display sheet 102 by a marginal region on the panel 98 immediately adjacent the side edge 88 thereof. As previously indicated, the backing sheet 80 is hole punched with holes 38 immediately adjacent its side edge 88 in the longitudinal margin in the panel 98 that is remote from the panel 96. The line of apertures 38 in the panel 98 is parallel to the longitudinal panel delineation fold 94.

The transparent display sheet 102 has top and bottom edges 106 and 108, respectively, and side edges 110 and 112. The backing sheet 80 is secured to the transparent display sheet 102 along the side edge 110, which is the connecting edge of the transparent display sheet 102. The backing sheet 80 and transparent display sheet 102 are joined together by the layer of adhesive 114, as depicted in detail in FIG. 7.

The combination 100 illustrated in FIGS. 5 and 6 differs from the protective devices 10 and 60, shown in FIGS. 1–4, in that the combination 100 employs a backing sheet 80 connected directly to the transparent display sheet 102, rather than two transparent protective sheets between which a transparent display sheet is positioned. However, the backing sheet 80 is foldable relative to the transparent display sheet 102 in the combination 100 in the same manner as depicted and described with reference to the pocket 28 formed by the pairs of transparent protective sheets in the embodiments of FIGS. 1–4.

Undoubtedly, numerous variations and modifications of the invention will become readily apparent to those familiar with office supply products. Accordingly, the scope of the invention should not be construed as limited to the specific embodiments illustrated and described.

I claim:

1. A device for protecting a transparent display sheet bearing material thereon for projected display comprising first and second transparent, protective sheets of generally rectangular configuration, each having a top edge and a bottom edge and a pair of side edges, wherein one of said side edges is a connecting edge, and said side edges of each of said transparent, protective sheets are greater in length than said top and bottom edges thereof, and said connecting edges of said protective sheets are mutually adjacent to each other, and said transparent, protective sheets are disposed in mutually overlying relationship and are secured together along said connecting edges, and further comprising a generally rectangular, opaque backing sheet having a top edge, a bottom edge, and a pair of side edges, one of which is a connecting edge, and said backing sheet is at least as large as each of said transparent, protective sheets and is joined along its connecting edge to said connecting edges of said transparent, protective sheets, and said opaque backing sheet is divided into a panel adjoining said connecting edges and a panel remote from said connecting edges by a longitudinal panel delineating fold between its top and bottom edges.

2. A device according to claim 1 wherein said first and second transparent protective sheets are secured together along all of said side edges and also along a transverse sealing area of mutual contact extending between said side edges to thereby form a transparent pocket for said transparent display sheet.

3. A device according to claim 2 further comprising a hole-punched attachment margin extending from at least one of said edges of at least one of said first and second transparency protective sheets for securement in a binder.

4. A device according to claim 3 wherein said attachment margin extends from at least one of said side edges other than said connecting edge of at least one of said protective sheets.

5. A device according to claim 2 wherein said backing sheet is wider than said pocket and is hole punched for insertion into a binder along its side edge other than said connecting edge thereof.

6. A device according to claim 1 wherein said backing sheet contains printed matter on said panel adjoining said connecting edges.

7. A device according to claim 1 further comprising a layer of adhesive joining said connecting edge of said backing sheet to said connecting edges of said transparent protective sheets.

8. A protector for a transparent display sheet bearing material thereon for projecting images comprising: first and second transparent protective sheets at least one of which is larger than said transparent display sheet and which defines a linear connecting edge and wherein said transparent protective sheets are disposed in mutually overlying relationship to form a pocket therebetween that receives said transparent display sheet, and a backing sheet at least as large as said pocket secured to at least said first transparent protective sheet along said connecting edge thereof, and said backing sheet is delineated into a pair of panels by a longitudinal fold that extends the length of said backing sheet parallel to said connecting edge, and said backing sheet is foldable to underlie said pocket and alternatively is foldable into a disposition laterally adjacent to said pocket and said panels are foldable along said longitudinal fold to reside in a face-to-face disposition and alternatively are foldable to reside in a coplanar, laterally-adjacent disposition relative to each other.

9. A protector according to claim 8 further comprising a hole-punched attachment margin extending from said transparent protective sheets for attachment in a binder.

10. A protector according to claim 8 wherein said backing sheet is wider than said first protective sheet thereby forming an attachment margin that is hole-punched for attachment in a binder and which extends beyond said first protective sheet when said backing sheet is folded to underlie said pocket.

11. A protector according to claim 8 further comprising a layer of adhesive joining said backing sheet to at least said first transparent protective sheet.

12. In combination, a rectangular, transparent display sheet having top and bottom edges and side edges and having material thereon for projected display, and a rectangular, opaque backing sheet at least as large as said transparent display sheet and secured thereto along one of said side edges of said transparent display sheet, wherein said backing sheet has a longitudinal panel delineation fold extending between and perpendicular to said top and bottom edges thereof, thereby dividing said backing sheet into a pair of panels, one of said panels being bounded by said transparent display sheet along one of its sides and by the other of said panels along an opposite one of said sides.

13. A combination according to claim 12 further comprising an adhesive layer joining said transparent display sheet to said backing sheet.

14. A combination according to claim 12 wherein said backing sheet is wider than said transparent display sheet and said other of said panels of said backing sheet is hold-punched for releasable attachment to a binder along a margin remote from said one of said panels with a line of apertures parallel to said longitudinal panel delineation fold.

15. A combination according to claim 12 wherein said backing sheet is further comprised of a connection margin delineated from said one of said panels by a longitudinal connection margin fold, whereby said panels are foldable together to contact and underlie said transparent display sheet and alternatively to lie alongside said transparent display sheet, and said panels are further foldable along said longitudinal panel delineation fold to reside in face-to-face relationship to each other.

* * * * *